US007248811B2

(12) United States Patent
Song et al.

(10) Patent No.: US 7,248,811 B2
(45) Date of Patent: Jul. 24, 2007

(54) OXIDATION CATALYST UNIT, A CONTROLLING METHOD THEREOF, AND A WET-TYPE ELECTROPHOTOGRAPHIC IMAGE FORMING APPARATUS COMPRISING THE OXIDATION CATALYST UNIT

(75) Inventors: Eun-Ah Song, Suwon-si (KR); Kwoang-Joe Seorl, Suwon-si (KR); Jung-Han Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 63 days.

(21) Appl. No.: 10/967,215

(22) Filed: Oct. 19, 2004

(65) Prior Publication Data

US 2005/0238381 A1 Oct. 27, 2005

(30) Foreign Application Priority Data

Apr. 27, 2004 (KR) ..... 10-2004-0028954

(51) Int. Cl.
*G03G 21/00* (2006.01)

(52) U.S. Cl. ..... 399/93

(58) Field of Classification Search ..... 399/91–93
See application file for complete search history.

(56) References Cited

FOREIGN PATENT DOCUMENTS

| | | | |
|---|---|---|---|
| JP | 01-263668 | | 10/1989 |
| JP | 06301260 | A * | 10/1994 |
| JP | 08-069228 | | 3/1996 |
| JP | 08-123298 | | 5/1996 |
| JP | 11212433 | A * | 8/1999 |
| JP | 2000-147962 | | 5/2000 |
| JP | 2000242146 | A * | 9/2000 |
| KR | 2002-0059508 | | 7/2002 |
| KR | 2004-0022944 | | 3/2004 |

OTHER PUBLICATIONS

Korean Office Action dated Nov. 22, 2005.

* cited by examiner

*Primary Examiner*—David M. Gray
*Assistant Examiner*—Ryan Gleitz
(74) *Attorney, Agent, or Firm*—Roylance, Abrams, Berdo & Goodman, L.L.P.

(57) ABSTRACT

An oxidation catalyst unit for a wet-type electrophotographic image forming apparatus which oxidizes a carrier vapor generated in a fusing unit and method for controlling the same are provided. The wet-type electrophotographic image forming apparatus includes a photoconductive medium, a laser scanning unit scans a laser beam onto the photoconductive medium, a developing unit develops a developer on the photoconductive medium, a transfer unit transfers the developer on the photoconductive medium to a recording medium, a fusing unit fixes the developer on the recording medium, and an oxidation catalyst unit oxidizes and resolves a carrier vapor generated in the fusing unit. The oxidation catalyst unit comprises a duct connected to the fusing unit to guide the carrier vapor generated in the fusing unit into the oxidation catalyst unit, a fan for guiding the carrier vapor into the duct, and a controller for varying a velocity of the fan according to data.

8 Claims, 5 Drawing Sheets

OXIDATION CATALYST UNIT, A CONTROLLING METHOD THEREOF, AND A WET-TYPE ELECTROPHOTOGRAPHIC IMAGE FORMING APPARATUS COMPRISING THE OXIDATION CATALYST UNIT

CROSS-REFERENCE TO RELATED APPLICATIONS

This application claims the benefit under 35 U.S.C. §119 (a) of Korean Patent Application No. 2004-28954, filed Apr. 27, 2004, in the Korean Intellectual Property Office, the entire disclosure of which is incorporated herein by reference.

BACKGROUND OF THE INVENTION

1. Field of the Invention

The present invention generally relates to an oxidation catalyst unit for a wet-type electrophotographic printer. More particularly, the present invention relates to an oxidation catalyst unit for oxidizing and thereby removing a carrier vapor generated in a fusing unit, a method for controlling the oxidation catalyst unit, and a wet-type electrophotographic image forming apparatus having the oxidation catalyst unit.

2. Description of the Related Art

An electrophotographic image forming apparatus scans a laser beam onto a photoconductive medium to form an electrostatic latent image, and transfers a visible image formed by attaching a developer onto the electrostatic latent image, thereby printing out a desired image. A wet-type electrophotographic image forming apparatus uses a liquid developer while a dry-type one uses a powder toner. The wet-type electrophotographic image forming apparatus produces a clearer image and high-quality color images can be obtained.

The developers consist of a toner and a liquid carrier, such as norpar. Norpar is a hydrocarbon-based solvent, which is a mixture of $C_{10}H_{22}$, $C_{11}H_{24}$, $C_{12}H_{26}$, and $C_{13}H_{28}$.

A paper onto which the developer is transferred passes through a fusing unit during which the toner component in the developer is fixed onto paper. When fused, liquid carrier, such as norpar, in the developer is vaporized by high temperature and discharged outward in the form of a hydrocarbon gas such as $CH_4$.

The hydrocarbon gas is a volatile organic compound (VOC), which emits an offensive odor when discharged. Therefore, various methods for removing hydrocarbon gas have been introduced.

Conventional methods for removing hydrocarbon gases include the filtration, direct combustion, and catalytic oxidation methods. The filtration method physically removes gaseous components using a carbon filter, such as an active carbon filter. The direct combustion method combusts gaseous components at an ignition point of approximately 600° C. to 800° C. The catalytic oxidation method combusts gaseous components at a relatively lower temperature of approximately 150° C. to 400° C. using a catalyst, thereby oxidizing and resolving the components into water and carbon dioxide.

In the filtration method, the carbon filter does not have the capability of resolving the entrained carrier vapors. Therefore, the carbon filter becomes saturated with carrier vapors and needs to be replaced when the carrier vapors are entrained over a predetermined amount in the carbon filter, and such replacement needs to be done frequently. Furthermore, the direct combustion method is not safe due to the high temperature generated. Due to above the problems, the wet-type electrophotographic image forming apparatuses have mainly employed the catalytic oxidation method for removing the carrier vapors.

FIG. 1 is a schematic view of a conventional oxidation catalyst unit. The oxidation catalyst unit 160 comprises a duct 161, a suction fan 162, a heater 163, an oxidation catalyst carrying medium 164, and a controller 165. The controller 165 comprises a driving part 165*a* for driving the suction fan 162 and a power part 165*b* for supplying electric power to the driving part 165*a*.

The duct 161, which is connected to one side of a fusing unit 150, guides the carrier vapor V into the oxidation catalyst unit 160 to remove the carrier vapor V produced in the fusing unit 150. This occurs when paper P moves through the fusing rollers 151 and 152.

The suction fan 162 is mounted in the duct 161 to forcibly send the carrier vapor V toward the oxidation catalyst carrying medium 164.

The heater 163 raises the temperature of the carrier vapor V to an activating temperature, for example, 200° C. The oxidation catalyst carrying medium 164 carries a catalyst such as Pt and Pd, which catalyzes the oxidization reaction. The oxidation catalyst carrying medium 164 is mounted behind the heater 163.

The suction fan 162 of the conventional oxidation catalyst unit 160, which draws in the carrier vapor V, rotates at a uniform velocity. The velocity of the suction fan 162 is determined or set based on the maximum amount of carrier vapor V. The maximum amount of carrier vapor V is mainly caused when printing a whole-color image.

FIG. 2 is a graph illustrating the fan velocity of the oxidation catalyst unit 160 of FIG. 1 according to the amount of image data. Referring to FIG. 2, whether printing a text image, which causes a relatively small amount of the carrier vapor V (FIG. 1), or a whole-color image, which causes a relatively larger amount of the carrier vapor V (FIG. 1), the suction fan 162 (FIG. 1) operates at the maximum velocity N. Therefore, the suction fan 162 (FIG. 1) is constantly applied with a load regardless of the amount of image data, and accordingly, the noise and vibration of the suction fan 162 increases due to the overload. In addition, power is wasted.

The above problems also occur when the temperature of the heater 163 in the oxidation catalyst unit 160 is set corresponding to the maximum amount of the carrier vapor V without regard to the actual amount of the carrier vapor V, or when the velocity of a cooling fan (not shown) of the image forming apparatus is always set corresponding to the maximum amount of the carrier vapor V without regard to the actual amount of the carrier vapor V.

Accordingly, there is a need for an oxidation catalyst unit wherein the heater temperature or the cooling fan velocity is set corresponding to the actual amount of carrier vapor V.

SUMMARY OF THE INVENTION

An aspect of the present invention is to solve at least the above problems and/or disadvantages and to provide at least the advantages described below. Accordingly, an aspect of the present invention is to provide an improved oxidation catalyst unit for effectively driving a fan, a method for controlling the oxidation catalyst unit, and a wet-type electrophotographic image forming apparatus having the oxidation catalyst.

In order to achieve the above-described aspects of the present invention, there is provided an oxidation catalyst unit for a wet-type electrophotographic image forming apparatus, which filters a carrier vapor generated in a fusing unit, comprising a duct connected to the fusing unit to guide the carrier vapor generated in the fusing unit into the oxidation catalyst unit, a suction fan for guiding the carrier vapor into the duct, and a controller for varying a velocity of the suction fan according to data. The data preferably represents an amount of image data being printed, a temperature and/or a humidity.

The oxidation catalyst unit further comprises a heater for heating the carrier vapor, and wherein the controller varies by the data pertaining to at least one of velocity of the suction fan and temperature of the heater.

The controller comprises a reading part for reading the data, an analyzing part for analyzing the read data, a suction fan driving part for controlling the velocity of the suction fan based on the analyzed data; and a heater controller for controlling the temperature of the heater based on the analyzed data. The data can be the amount of image data, a temperature measurement, humidity measurement, or the like.

The analyzing part comprises a memory part for storing a reference data, a data comparison part for comparing the data with the reference data, a suction fan velocity determination part for determining a velocity of the suction fan according to a result of the comparison; and a heater temperature determination part for determining the temperature of the heater.

The velocity determination part either intermittently or continuously controls the suction fan velocity. The data may be the amount of image data, a temperature, or the amount of humidity.

In order to achieve another aspect of the present invention, there is provided a wet-type electrophotographic image forming apparatus comprising a photoconductive medium, a laser scanning unit, a developing unit, a transfer unit, a fusing unit and an oxidation catalyst. The laser scanning unit scans a laser beam onto the photoconductive medium. The developing unit develops a developer on the photoconductive medium. The transfer unit transfers the developer on the photoconductive medium to a sheet of paper or other suitable recording medium. The fusing unit fixes the developer on the sheet of paper or other suitable recording medium. The oxidation catalyst unit oxidizes and resolves the carrier vapor generated in the fusing unit.

The oxidation catalyst unit comprises a duct connected to the fusing unit to guide the carrier vapor generated in the fusing unit into the oxidation catalyst unit, a suction fan for guiding the carrier vapor into the duct, and a controller for varying the velocity of the suction fan according to data.

The wet-type electrophotographic image forming apparatus further comprises a heater for heating the carrier vapor; and a cooling fan for cooling the inner temperature of the oxidation catalyst unit, wherein the controller varies based on the data at least one of velocity of the suction fan and temperature of the heater.

The controller comprises a reading part for reading the data; an analyzing part for analyzing the read data; a suction fan driving part for driving the suction fan based on the analyzed data; a heater temperature determination part for determining the temperature of the heater; and a cooling fan driving part for driving the cooling fan based on the analyzed data.

The analyzing part comprises a memory part for storing reference data; a data comparison part for comparing the data with the reference data; a suction fan velocity determination part for determining a velocity of the suction fan according to the result of the comparison; a heater temperature determination part for determining the temperature of the heater; and a cooling fan velocity determination part for determining the velocity of the cooling fan.

In order to achieve another aspect of the present invention, there is provided a method for controlling an oxidation catalyst unit in a wet-type electrophotographic image forming apparatus, the method comprising the steps of reading data, analyzing the read data, and driving a suction fan based on the analyzed data.

The method further comprises the steps of controlling the temperature of the heater as analyzed; and driving the cooling fan based on the analyzed data.

The analyzing step further comprises the steps of comparing the data with reference data, and determining the velocity of the suction fan according to the comparison result, determining the temperature of the heater according to the comparison result; and determining the velocity of the cooling fan according to the comparison result.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Figure 1:
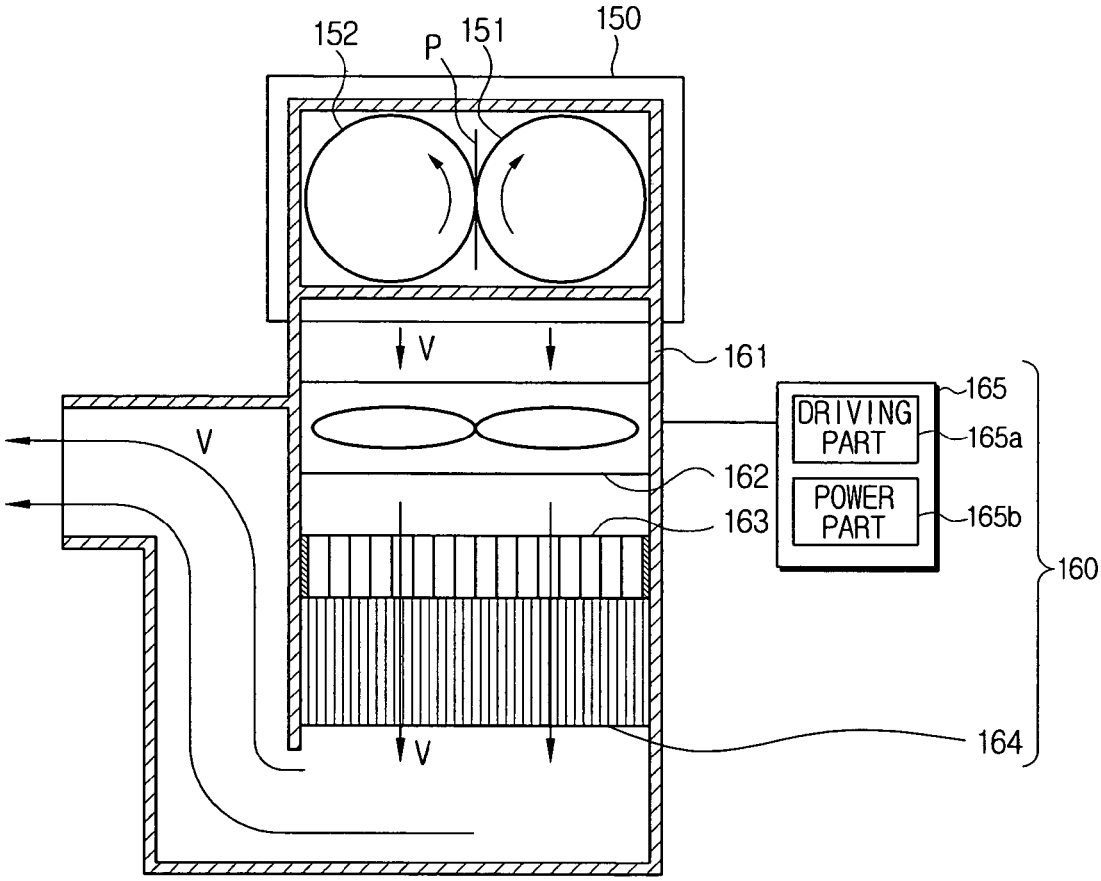
FIG. 1 (PRIOR ART)
FIG. 1 is a schematic view of a conventional oxidation catalyst unit.

Hereinafter, embodiments of the present invention will be described in detail with reference to the accompanying drawing figures.

In the following description and drawings, it should be understood that like reference numerals represent like features and structures. The matters defined in the description such as a detailed construction and elements are provided to assist in a comprehensive understanding of the invention. Also, descriptions of well-known functions or constructions are omitted for sake of clarity.

Figure 3:
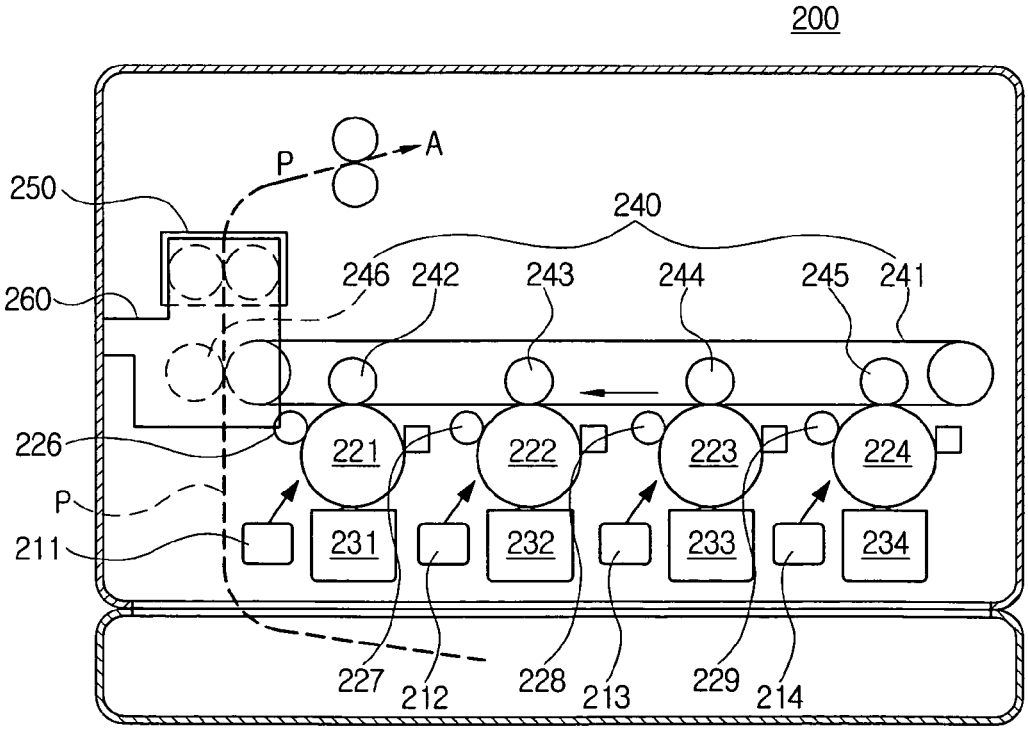
FIG. 3 is a schematic view of a wet-type electrophotographic image forming apparatus according to an embodiment of the present invention.
Figure 4:
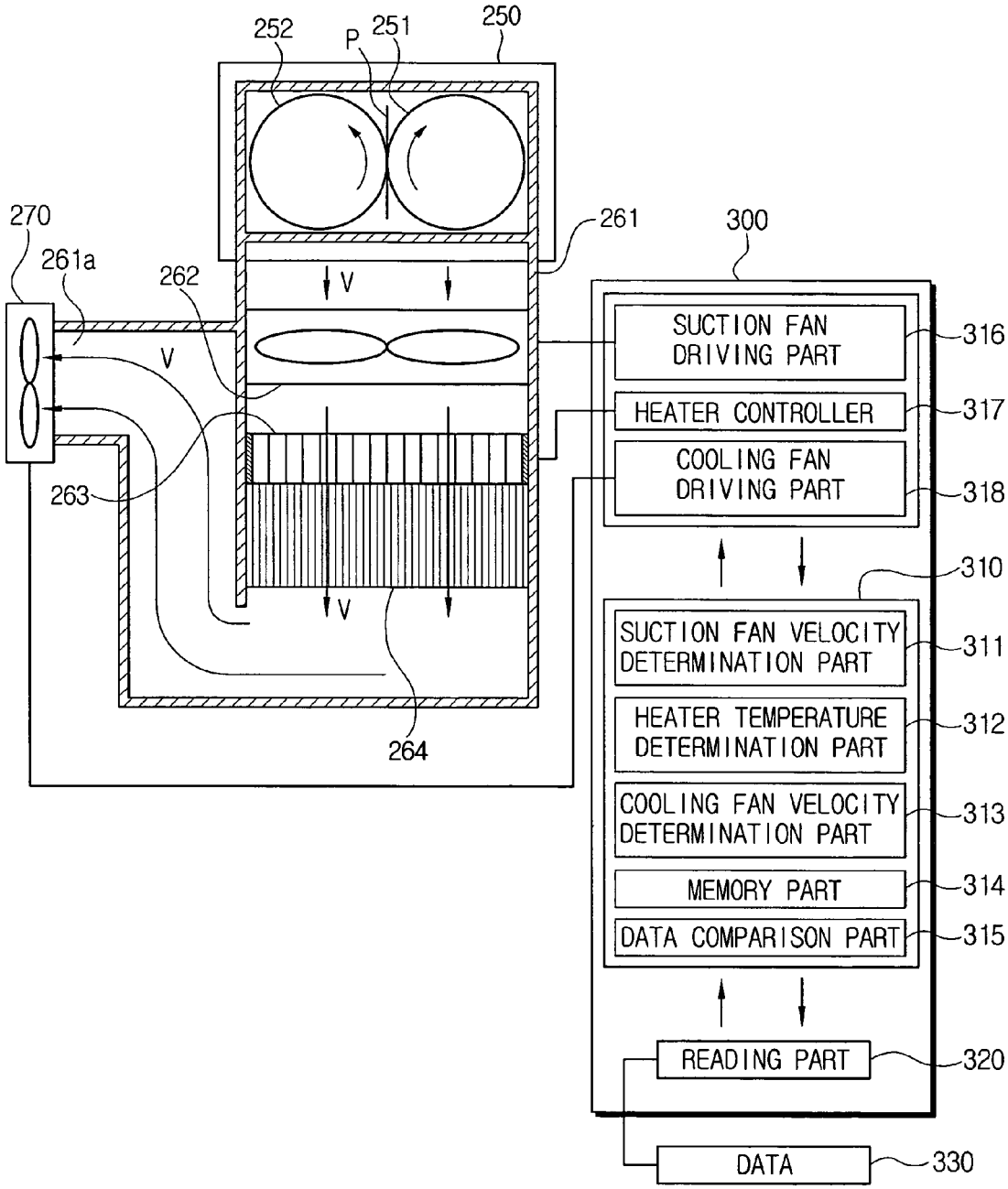
FIG. 4 is a schematic enlarged view of a fusing unit and an oxidation catalyst unit of FIG. 3.

Referring to FIGS. 3 and 4, which is a schematic view of a wet-type electrophotographic image forming apparatus according to an embodiment of the present invention, the wet-type electrophotographic image forming apparatus 200 comprises a plurality of laser scanning units 211, 212, 213 and 214, a plurality of photoconductive drums 221, 222, 223 and 224, a plurality of electrification units 226, 227, 228 and 229, a plurality of developing units 231, 232, 233 and 234, a transfer unit 240, a fusing unit 250, an oxidation catalyst unit 260, and a cooling fan 270.

The plurality of laser scanning units 211, 212, 213 and 214 scan a laser beam onto the photoconductive drums 221, 222, 223 and 224, respectively, which are electrified to a predetermined electric potential by the electrification units 226, 227, 228 and 229.

The surfaces of the photoconductive drums 221, 222, 223 and 224 are coated with a photoconductive sensitization layer, and therefore, a difference in the electric potentials are caused on the surfaces of the photoconductive drums 221, 222, 223 and 224 scanned with the laser beam, which forms an electrostatic latent image.

The developing units 231, 232, 233 and 234 supply the developer respectively to the photoconductive drums 221, 222, 223 and 224. The developing units 231, 232, 233 and 234 respectively store developers of different colors such as yellow, magenta, cyan and black. Upon formation of the electrostatic latent image on the photoconductive drums 221, 222, 223 and 224, the developing units 231, 232, 233 and 234 transfer the respective color developers onto the photoconductive drums 221, 222, 223 and 224.

Accordingly, visible images are formed by the developers on the surfaces of the respective photoconductive drums 221, 222, 223 and 224. The developers consist of a toner for developing the electrostatic latent image and a liquid carrier for helping movement of the toner. The liquid carrier preferably comprises a combustible hydrocarbon gas such as norpar.

Figure 2:
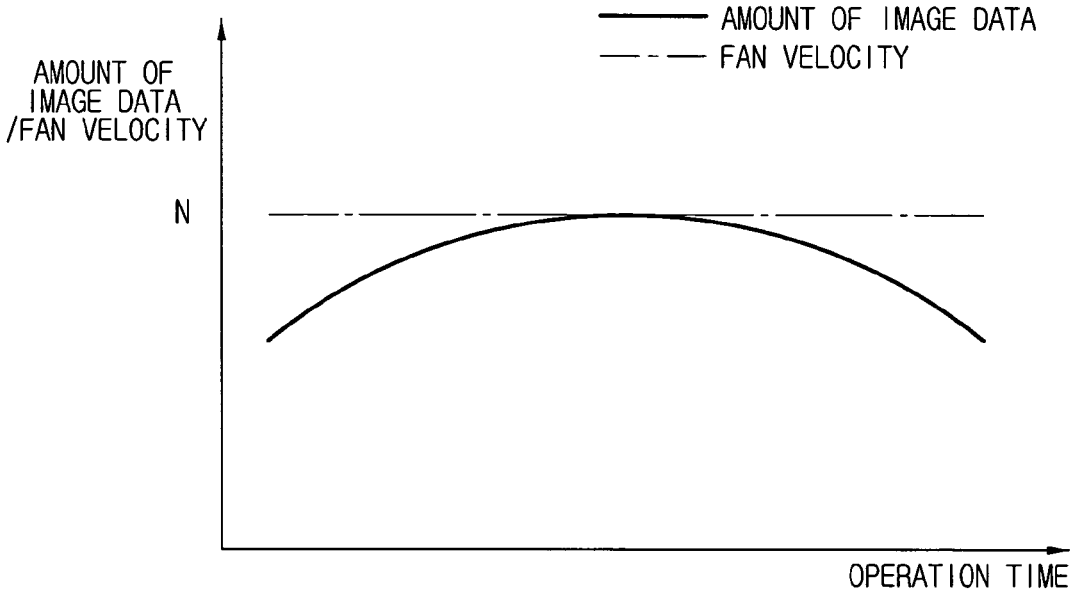
FIG. 2 (PRIOR ART)
FIG. 2 is a graph illustrating the fan velocity of the oxidation catalyst unit of FIG. 1 according to the amount of image data.

The transfer unit 240 transfers the visible images formed on the photoconductive drums 221, 222, 223 and 224 onto a paper. The transfer unit 240 comprises a transfer belt 241, first transfer rollers 242, 243, 244 and 245, and a second transfer roller 246. As shown in FIG. 2, the transfer belt 241 receives the visible images while running in contact with the surfaces of the photoconductive drums 221, 222, 223 and 224. The respective first transfer rollers 242, 243, 244 and 245 are mounted corresponding to the photoconductive drums 221, 222, 223 and 224 to transfer the visible images on the photoconductive drums 221, 222, 223 and 224 onto the transfer belt 241. The developers of different colors such as yellow, magenta, cyan and black are overlapped with each other on the transfer belt 241, thereby forming a color image. The second transfer roller 246 transfers the color image formed on the transfer belt 241 onto a paper.

The cooling fan 270 discharges heat inside the oxidation catalyst unit 260, such that the wet-type electrophotographic image forming apparatus 200 operates in an optimum condition.

The fusing unit 250 comprises a heating roller 251 and a pressing roller 252 in tight contact with each other, and the paper P passes through therebetween. When the paper passes through the fusing unit 250, the toner in the developers is fixed on the paper while the liquid carrier such as the norpar is vaporized in the form of a combustible hydrocarbon gas such as $CH_4$ by a high temperature. For the oxidation into water and carbon dioxide and discharge of the hydrocarbon gas, the fusing unit 250 has the oxidation catalyst unit 260 at one side thereof.

The oxidation catalyst unit 260 comprises a duct 261, a suction fan 262, a heater 263, an oxidation catalyst carrying medium 264, and a controller 300. The duct 261 connected to the fusing unit 250 guides the carrier vapor V generated in the fusing unit 250 to the inside of the oxidation catalyst unit 260. The suction fan 262 installed at an inlet of the duct 261 forcibly discharges the carrier vapor V generated in the fusing unit 250 toward the oxidation catalyst carrying medium 264. The heater 263 installed within the duct 261 heats the carrier vapor V. The oxidation catalyst carrying medium 264 installed next to the heater 263 within the duct 261 catalyzes the oxidation reaction of the carrier vapor V.

The controller 300 comprises a reading part 320 for reading data 330, an analyzing part 310 for analyzing the read data 330, a suction fan driving part 316 for driving the suction fan 262 according to the analyzed data 330, a heater controller 317 for adjusting a temperature of the heater 263, and a cooling fan driving part 318 for driving the cooling fan 270.

However, the heater controller 317 and the cooling driving fan 318 are dispensable and may be omitted because the suction fan 262 mounted adjacent to the fusing unit 250 and the suction fan driving part 316, which drives the suction fan 262, satisfactorily perform their function of promptly coping with a changing amount of carrier vapor V.

However, in this embodiment, the controller 300 comprises the suction fan driving part 316, the heater controller 317 and the cooling fan driving part 318. The controller 300 controls the velocity of the suction fan 262, the cooling fan 270 and the temperature of the heater 263 according to the changing amount of generated carrier vapor V.

The analyzing part 310 comprises a memory part 314, a data comparison part 315, a suction fan velocity determination part 318, a heater, temperature determination part 312, and a cooling fan velocity determination part 313. The memory part 314 stores reference data. The data comparison part 315 compares the data 330 with the reference data. The suction fan velocity determination part 311 determines the velocity of the suction fan 262 according to the result of the comparison. The heater temperature determination part 312 determines the temperature of the heater 263. The cooling fan velocity determination part 313 determines the velocity of the cooling fan 270.

The data 330 may be one or more of the following: the amount of image data, a temperature, or a humidity. The temperature and the humidity are preferably measured at an outlet 261*a* of the duct 261 to confirm whether the measured temperature and humidity are in the range for the best performance of the catalyst in the oxidation catalyst carrying medium 264.

The image data amount is calculated by the following prediction equation.

Amount of carrier vapor to be generated=image coverage*(Mass/Area)* % Solid;

where the image coverage is area to be covered by developer, (Mass/Area) is the mass of developer (toner plus carrier) and % Solid is the percentage of toner in the developer.

That is, the image data amount is calculated by multiplying the developer (toner+carrier) applied on the image coverage per unit area by a percentage of the toner in the developer. According to the above, the reference data corresponding to the image data amount is found. The amount of image data is then used to predict the amount of carrier vapor that will be generated when this particular image is printed.

The reference data can also comprise suction fan velocity data, which may be based on the image data amount, heater temperature data and cooling fan velocity data. To obtain the above data, the suction fan velocity determination part 311 determines the velocity of the suction fan 262, the heater temperature determination part 312 determines the temperature of the heater 263, and the cooling fan velocity determination part 313 determines the velocity of the cooling fan 270.

The image data amount is preferably used as an input to the controller 300 since it predicts the amount of carrier vapor V before it is actually generated unlike the temperature and humidity.

With the arrangement as shown in FIGS. 3 and 4, when the paper passes through the fusing unit 250, the toner in the developers is fixed on the paper P while the liquid carrier, such as the norpar, is vaporized in the form of a hydrocarbon gas such as $CH_4$ by high temperature.

The carrier vapor V is guided into the oxidation catalyst unit 260 along the duct 261 connected to the fusing unit 250. At this time, the suction fan 262 mounted in the oxidation catalyst unit 260 forcibly sends the carrier vapor V toward the heater 263.

The carrier vapor V passed through the heater 263 is moved to the oxidation catalyst carrying medium 264 and is oxidized into water and carbon dioxide.

The reading part 320 reads the data 330 such as the image data amount, the temperature and the humidity, and the analyzing part 310 analyzes the data 330 by referring to the reference data stored to the memory 314 and finds the optimum velocity for the suction fan 262, the temperature of the heater 263 or the velocity of the cooling fan 270 corresponding to the image data amount, the temperature and the humidity, The suction fan velocity determination part 311, the heater temperature determination part 312 and the cooling fan velocity determination part 313 of the analyzing part 310 respectively determines the optimum suction fan velocity, the heater temperature and the cooling fan velocity. The analyzing part 310 transmits an operation signal to the suction fan driving part 316, the heater temperature controller 317 and the cooling fan driving part 318. Here, the analyzing part 310 can transmit the operation signal consecutively or simultaneously or to only one of either the suction fan driving part 316, the heater temperature controller 317 or the cooling fan driving part 318, according to a programmed algorithm.

Then, the suction fan driving part 316, the heater temperature controller 317 and the cooling fan driving part 318 respectively vary the velocity of the suction fan 262, the temperature of the heater 263 and the velocity of the cooling fan 270 according to the amount of carrier vapor V. The velocity of the suction fan 262 is adjustable, that is, it is either intermittent or constant.

Figure 5A:
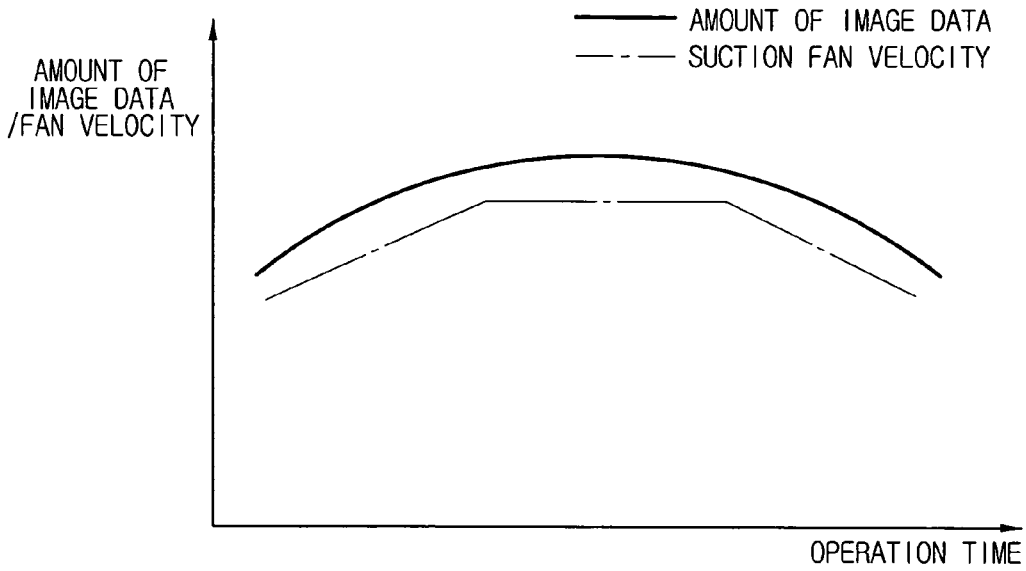
FIG. 5A is a graph illustrating that the fan velocity of the oxidation catalyst unit of FIG. 4 is intermittently controlled as the amount of image data varies.

Referring to FIG. 5A, when the velocity of the suction fan 262 is set according to a certain range for the amount of image data, the suction fan velocity is uniformly maintained. However, when the suction fan velocity gets beyond the certain range, the suction fan velocity changes. The changed velocity is also uniformly maintained when within the certain range of the image data amount, and changed when the amount of image data is outside of the certain range. Therefore, when the amount of image data calculated by the analyzing part 310 decreases, the load on the suction fan driving part 316, which drives the suction fan 262, can also be decreased; thereby being intermittently controlled.

Figure 5B:
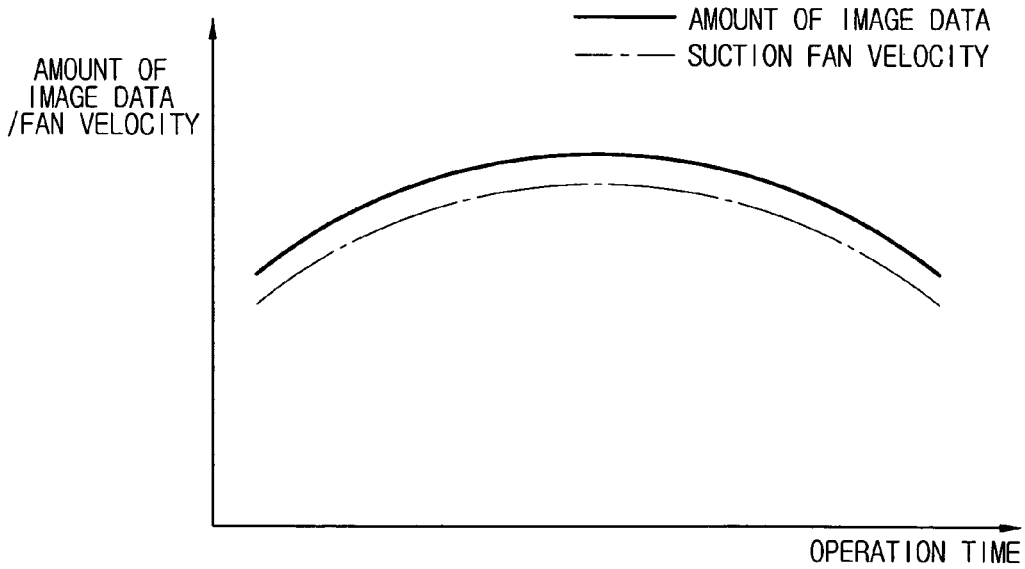
FIG. 5B is a graph illustrating that the fan velocity of the oxidation catalyst unit of FIG. 4 is continuously controlled as the amount of image data varies.

Referring to FIG. 5B, when the suction fan velocity varies in proportion to the change of the image data amount. Accordingly, constant control of the suction fan 262 in proportion to the image data amount becomes available.

Figure 6:
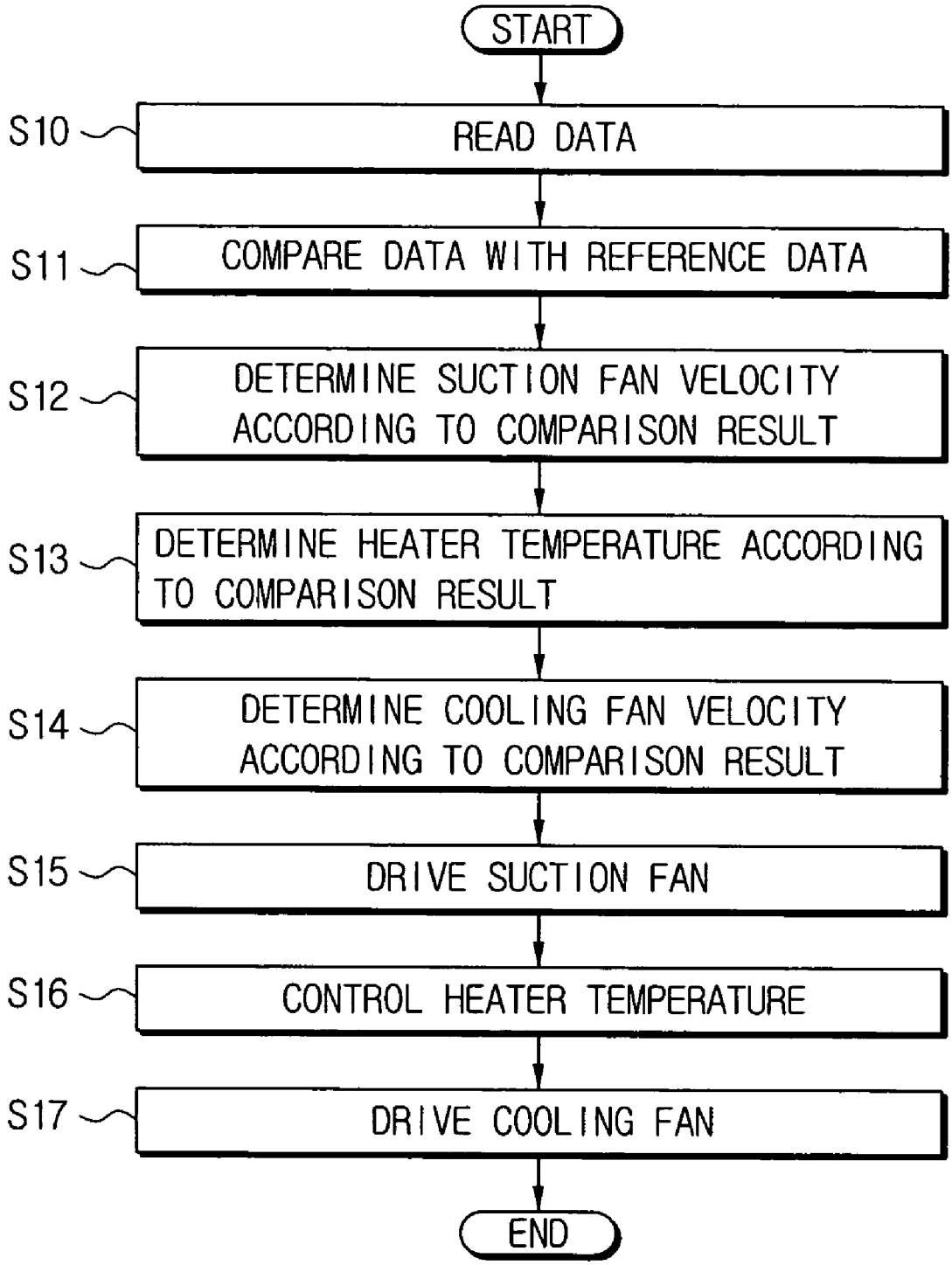
FIG. 6 is a block diagram illustrating a method for controlling the oxidation catalyst unit of FIG. 4 according to an embodiment of the present invention.

FIG. 6 is a block diagram showing a controlling method for the oxidation catalyst unit of FIG. 4. The controlling method comprises the steps of reading the data 330 (S10), comparing the read data 330 with the reference data (S11), determining the velocity of the suction fan 262 based on the result of the comparison (S12), determining the temperature of the heater 263 according to the comparison result (S13), determining the velocity of the cooling fan 270 according to the comparison result (S14), driving the suction fan 262 according to a result of analyzation (S15), controlling the temperature of the heater 263 (S16), and driving the cooling fan 270 according to the result of analyzation (S17).

As can be appreciated from the above description, according to embodiments of the present invention, the velocities of the suction fan and the cooling fan, the heater temperature of the oxidation catalyst unit 260 can be varied in accordance with the temperature, the humidity and the change in the amount of image data. Therefore, the noise and vibration that are typically generated from overloading the suction fan 262, cooling fan 270 and the heater 263 as well as power consumption are reduced. Also, overheating of the oxidation catalyst 260 is prevented.

While the invention has been shown and described with reference to certain embodiments thereof, it will be understood by those skilled in the art that various changes in forms and details may be made therein without departing from the spirit and scope of the invention as defined by the appended claims.

What is claimed is:

1. An oxidation catalyst unit for a wet-type electrophotographic image forming apparatus which filters a carrier vapor generated in a fusing unit, comprising:

a duct connected to the fusing unit to guide the carrier vapor generated in the fusing unit into the oxidation catalyst unit;

a suction fan for guiding the carrier vapor into the duct;

a heater for heating the carrier vapor; and a controller for varying the velocity of the suction fan and a temperature of the heater according to data, wherein the data consists of at least one of an amount of image data, a temperature measurement, and a humidity measurement, and at least one of the velocity of the suction fan and the temperature of the heater.

2. The oxidation catalyst unit of claim 1, wherein the controller comprises:

a reading part for reading the data;

an analyzing part for analyzing the read data and;

a suction fan driving part for controlling the velocity of the section fan based on the analyzed data.

3. The oxidation catalyst unit of claim 2, wherein the analyzing part comprises:

a memory part for storing reference data;

a data comparison part for comparing the data with the reference data;

a suction fan velocity determination part for determining the velocity of the suction fan according to a result of the comparison; and a heater temperature determination part for determining the temperature of the heater.

4. The oxidation catalyst unit of claim 3, wherein the suction fan velocity determination part intermittently determines the suction fan velocity.

5. The oxidation catalyst unit of claim 3, wherein the suction fan velocity determination part constantly determines the suction fan velocity.

6. A wet-type electrophotographic image forming apparatus comprising:

a photoconductive medium;

a laser scanning unit for scanning a laser beam onto the photoconductive medium;

a developing unit for developing a developer on the photoconductive medium;

a transfer unit for transferring the developer on the photoconductive medium to a recording medium;

a fusing unit for fixing the developer on the recording medium; and an oxidation catalyst unit for oxidizing and resolving a carrier vapor generated in the fusing unit, wherein the oxidation catalyst unit comprises:

a duct connected to the fusing unit to guide the carrier vapor generated in the fusing unit into the oxidation catalyst unit;

a suction fan for guiding the carrier vapor into the duct;

a heater for heating the carrier vapor;

a cooling fan for cooling an inner temperature of the oxidation catalyst unit; and a controller for varying a velocity of the suction fan and the cooling fan, and a temperature of the heater according to data, wherein the data consists of at least one of an amount of image data, a temperature measurement, and a humidity measurement, and at least one of the velocity of the section fan and the temperature of the heater.

7. The wet-type electrophotographic image forming apparatus of claim 6, wherein the controller comprises:

a reading part for reading the data;

an analyzing part for analyzing the read data;

a section fan driving part for driving the suction fan based on the analyzed data; and a cooling fan driving part for driving the cooling fan based on the analyzed data.

8. The wet-type electrophotographic image forming apparatus of claim 7, wherein the analyzing part comprises:

a memory part for storing reference data;

a data comparison part for comparing the data with the reference data;

a suction fan velocity determination part for determining a velocity of the suction fan according to the result of the comparison;

a heater temperature determination part for determining the temperature of the heater according to the result of the comparison; and a cooling fan velocity determination part for determining the velocity of the cooling fan according to the result of the comparison.

* * * * *